United States Patent [19]

Miyamoto et al.

[11] Patent Number: 4,868,606

[45] Date of Patent: Sep. 19, 1989

[54] COPYING APPARATUS CAPABLE OF FORMING VARIOUS TYPES OF IMAGES

[75] Inventors: Hirohisa Miyamoto; Keiji Kusumoto, both of Osaka, Japan

[73] Assignee: Minolta Camera Kabushiki Kaisha, Osaka, Japan

[21] Appl. No.: 269,988

[22] Filed: Nov. 10, 1988

[30] Foreign Application Priority Data

Nov. 13, 1987 [JP] Japan ..... 62-287780
Nov. 13, 1987 [JP] Japan ..... 62-287784

[51] Int. Cl.[4] ..... G03G 15/00; G03G 15/01

[52] U.S. Cl. ..... 355/218; 355/202; 355/210; 355/244; 355/260; 355/326

[58] Field of Search ..... 355/218, 202, 210, 244, 355/260, 245, 326

[56] References Cited

U.S. PATENT DOCUMENTS

| | | | |
|---|---|---|---|
| 4,639,119 | 1/1987 | Isaka | 355/260 X |
| 4,640,601 | 2/1987 | DeGuchi et al. | 355/218 |
| 4,679,927 | 7/1987 | Sogo et al. | 355/218 |
| 4,692,018 | 9/1987 | Tamura | 355/260 |
| 4,696,541 | 9/1987 | Sakai et al. | 355/326 X |
| 4,707,109 | 11/1987 | Kanno et al. | 355/218 |
| 4,710,016 | 12/1987 | Watanabe | 355/326 |
| 4,720,730 | 1/1988 | Ito et al. | 355/4 |
| 4,723,146 | 2/1988 | Kasahara | 355/326 |
| 4,757,344 | 7/1988 | Ioenawa et al. | 355/260 |
| 4,761,673 | 8/1988 | Watanabe et al. | 355/218 X |

FOREIGN PATENT DOCUMENTS

| | | |
|---|---|---|
| 51-134635 | 11/1976 | Japan . |
| 54-30833 | 3/1979 | Japan . |

OTHER PUBLICATIONS

U.S. Patent Application Ser. No. 16,716, filed Feb. 19, 1989.

U.S. Patent Application Ser. No. 16,717, filed Feb. 19, 1989.

U.S. Patent Application Ser. No. 46,944, filed May 7, 1987.

U.S. Patent Application Ser. No. 58,266, filed May 21, 1987.

U.S. Patent Application Ser. No. 71,261, filed Jul. 8, 1987.

U.S. Patent Application Ser. No. 71,263, filed Jul. 8, 1987.

U.S. Patent Application Ser. No. 117,836, filed Nov. 9, 1987.

U.S. Patent Application Ser. No. 119,833, filed Nov. 12, 1987.

*Primary Examiner*—A. C. Prescott

*Attorney, Agent, or Firm*—Willian Brinks Olds Hofer Gilson & Lione

[57] ABSTRACT

Three mounting portions are provided along a direction of rotation of a photoreceptor with an eraser lamp and a corona charger provided on the upstream side of the mounting portions. A first developing unit, an outline unit and a second developing unit, each of which can be attached to and detached from each of the mounting portions, are mounted in this order from the upstream side. When an outline mode is selected, colors of the developing units mounted on the downstream side of the outline unit are displayed on a display portion. When there is no developing unit on the downstream side, no color is displayed, and the copying operation in the outline mode is prohibited. If there is only one developing unit on the downstream side, the copying operation is started by pressing a copying key. If there are a plurality of developing units on the downstream side, a plurality of colors are displayed, and the copying operation is prohibited until one of those colors is designated.

10 Claims, 10 Drawing Sheets

COPYING APPARATUS CAPABLE OF FORMING VARIOUS TYPES OF IMAGES

BACKGROUND OF THE INVENTION

Field of the Invention

The present invention generally relates to a copying apparatus and, more specifically, to a copying apparatus having a function of forming color copies as well as a function of forming outline images. Description of the Prior Art Recently, devices capable of forming not only black images but color images such as red, blue and so on have been developed in the field of image forming apparatuses such as copying machines employing electrophotography process. More specifically, a plurality of developing devices are arranged around a photoreceptor, and a color developing device containing developer with color toner can be selectively mounted and used by replacing other color developing devices.

In consideration of the recognization that an outline of an image is very important, comprising much information and representing characteristics of the image, the applicants of the present application have proposed a method for forming an outline image, in which a second charging apparatus is provided between an image exposing apparatus and a developing device, and only outlines of a picture are extracted to form outline images, and line images are directly reproduced as the line images by the operation of the second charging apparatus (disclosed in USSN Nos. 16,716 and 16,717).

Let us consider a case in which a function of forming outline images is implemented in a unit (hereinafter referred to as an outline unit) compatible with the developing devices, and the unit is mounted on a copying machine capable of mounting a plurality of developing devices. In that case, the outline unit should be arranged on the upstream side of developing devices in the direction of movement of the photoreceptor. If three or more developing devices are mounted to turn the latent electrostatic images of the outline portions to toner images, the outline unit should be arranged on the upstream side of the developing devices so as to enable selection of developing devices arranged on the downstream side of the outline unit, to prevent the generation of miscopies.

Conventionally, the selection of developing color is carried out by searching all mounted developing devices one by one. Sometimes erroneous selection results from this process.

SUMMARY OF THE INVENTION

An object of the present invention is to provide an electrophotographic copying apparatus having an outline forming unit which can be handled easily.

Another object of the present invention is to provide an electrophotographic copying apparatus having an outline forming unit capable of reducing miscopies.

A further object of the present invention is to provide an electrophotographic copying apparatus having an outline forming unit which is capable of development of a desired color in a single manner.

In order to attain the above described objects, the electrophotographic copying apparatus of the present invention comprises, in a broad sense, a photoreceptor; a plurality of mounting portions; first image forming means; a plurality of developing units; and display means. The photoreceptor is movable. The plurality of mounting portions are provided in the vicinity of the photoreceptor and along a direction of movement of the photoreceptor. The first image forming means can be attached to and detached from each of the mounting portions, and forms a first latent electrostatic image on the photoreceptor, when mounted on any one of the mounting portions. Each of the plurality of developing units can be attached to and detached from each of the mounting portions, and develops the latent electrostatic image formed on the photoreceptor when mounted on any one of the mounting portions. The display means displays at least one of the developing units mounted on the downstream side in the direction of movement of the photoreceptor.

In order to attain the above described objects, the electrophotographic copying apparatus of the present invention comprises, in a certain aspect, a photoreceptor; image forming means; a plurality of mounting portions; a plurality of developing units; an outline unit; instructing means; mode selecting means; prohibiting means; developing color selecting means; automatic selecting means; releasing means; and executing means. The photoreceptor is movable. The image forming means forms latent electrostatic images on the photoreceptor. The plurality of mounting portions are provided in the vicinity of the photoreceptor along a direction of movement of the photoreceptor. Each of the plurality of developing units can be attached to and detached from each of the mounting portions, and develops the latent electrostatic images on the photoreceptor when mounted on any one of the mounting portions. The outline unit can be attached to and detached from each of the mounting portions, and forms a latent electrostatic image with the outline portions emphasized by applying charges on the latent electrostatic image on the photoreceptor when mounted on any mounting portion. The instructing means instructs start of the copying operation. The mode selecting means selects an outline copying mode. The prohibiting means prohibits copying, when the outline mode is selected by the mode selecting means and there are a plurality of developing units mounted on the downstream side of the mounted outline unit in the direction of movement of the photoreceptor. The developing color selecting means selects any one of the plurality of developing units mounted on the downstream side in the direction of movement of the photoreceptor. The automatic selecting means selects, when the outline mode is selected by the mode selecting means and only one developing unit is mounted on the mounting portion in the downstream side of the outline unit in the direction of movement of the photoreceptor, that developing unit. The releasing means releases the copying operation prohibited state, when a developing unit is selected by the developing color selecting means in the state in which the copying operation is prohibited by the prohibiting means. The executing means activates the outline unit and the developing unit selected by the developing color selecting means or by the automatic selecting means, to carry out the copying operation.

The electrophotographic copying apparatus of the present invention structured as described above displays developing unit capable of the developing the first latent electrostatic image, in a broad sense, and therefore, whether the first latent electrostatic image can be developed with a desired color or not can be easily determined.

In a certain aspect, in the electrophotographic copying apparatus of the present invention structured as described above, the copying operation can be executed when only one unit is capable of developing the first latent electrostatic image upon selection of the outline copying mode. When a plurality of developing units are capable of the development, the copying operation is prohibited until one of those units is selected. When one developing unit is selected, the prohibition is released, and the copying operation is carried out, whereby the copy of a desired color can be easily and surely provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described in the following with reference to appended drawings.

(a) Structure of the copying machine

Figure 1:
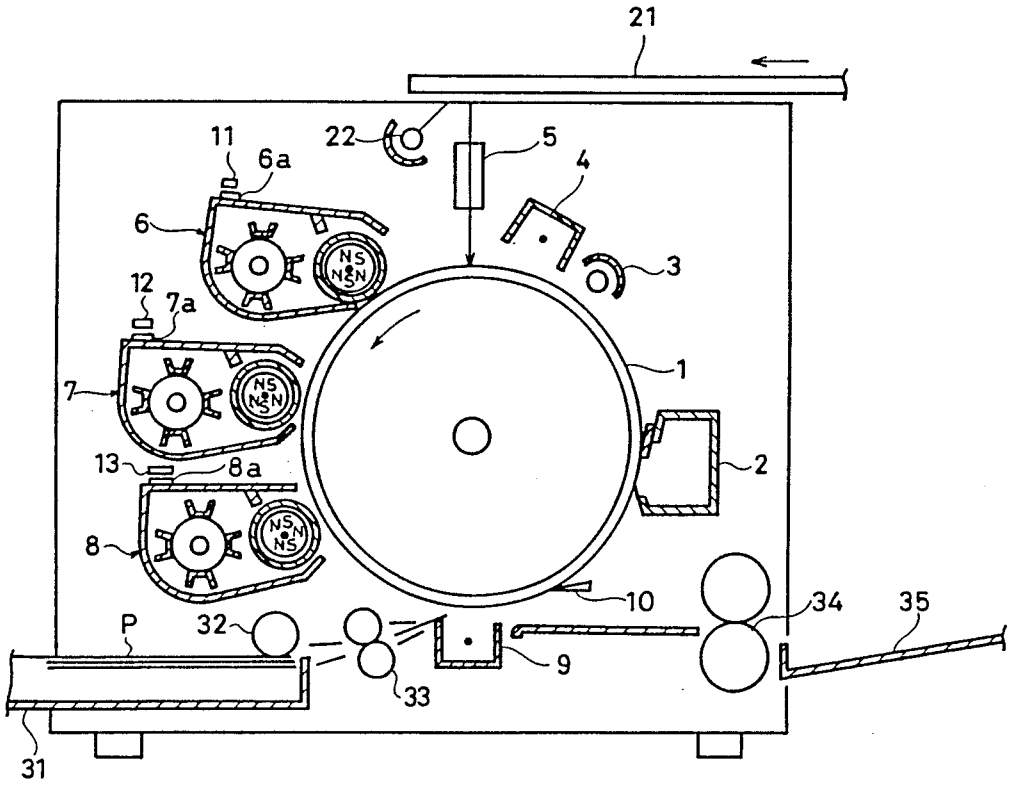
FIG. 1 cross sectional view showing a schematic structure, copying machine in accordance with one embodiment of the present invention.

FIG. 1 is a schematic cross sectional view of the copying machine in accordance with one embodiment of the present invention.

Around a photoreceptor drum 1 are provided a blade type cleaning apparatus 2, an eraser lamp 3, a corona charger 4, a lens array 5, developing units 6, 7 and 8 detachably attached to respective mounting portions, at the upper stage, middle stage and the lower stage of the body of the copying machine, a transfer charger 9, and a separating pawl 10.

An original placed on an original glass support 21 is irradiated by an exposure source 22. Light reflected from the original irradiates the photoreceptor drum through the lens array 5. The original is scanned by the movement of the original glass support. The charged photoreceptor drum 1 receives the image exposure to form a latent electrostatic image. Toner is applied on the latent electrostatic image by the above described developing units 6, 7 or 8. The toner image on the photoreceptor drum is transferred onto a paper by the transfer charger 9. Papers P on which the toner image is to be transferred are contained in a paper feeding cassette 31. The paper is fed by a paper feeding roller 32 to a timing roller 33. The timing roller 33 feeds the paper transferred from the paper feeding with the front edge of the paper aligned with the toner image forming region on the photoreceptor drum 1. The toner image is transferred onto the fed paper by the transfer charger 9. The paper is then separated from the surface of the photoreceptor drum 1 by the separating pawl 10. The toner is heat fixed by a fixing roller 34, and the paper is discharged to a discharge tray 35. A driving motor (main motor), not shown, is provided in the copying machine, which drives the photoreceptor 1, the paper feeding roller 32, the timing roller 33, the developing units 6, 7 and 8, the fixing roller 34, and so on. The main motor can be connected to the paper feeding roller 32, the timing roller 33 and to the developing units 6, 7 and 8 by a clutch or the like (not shown) so that each of these components can operate independently.

The developing units 6, 7 and 8 are detachably mounted on respective mounting portions at the upper stage, middle stage and lower stage of the body of the copying machine, as shown in FIG. 1. The developing color can be changed by mounting a developing unit having toner of different color, which is separately prepared, onto any of the mounting portions in place of the mounted developing unit. Connectors 11, 12 and 13 are arranged at the respective mounting portions and are connected to DIP switches 6*a*, 7*a* and 8*a* provided on upper surfaces of the mounted developing units 6, 7 and 8. Each of the DIP switches 6*a*, 7*a* and 8*a* comprises three contacts, and represents 3 bit code in accordance with the open/close condition of these three contacts. Different 3 bit codes are allotted, corresponding to the toner colors, to respective developing units 6, 7 and 8. A service man or a user can mount a developing unit to the mounting portion of the body, with the open/close state of the contacts of the DIP switch of that developing unit corresponding to the code allotted in association with the desired toner color. The 3 bit code signals from the DIP switches of the mounted developing units are inputted to a CPU 100 (FIG. 4), which will be described later, through the connectors 11, 12 and 13. The CPU 100 identifies the toner colors of the developing units mounted on the respective mounted portions based on the signals.

Figure 2:
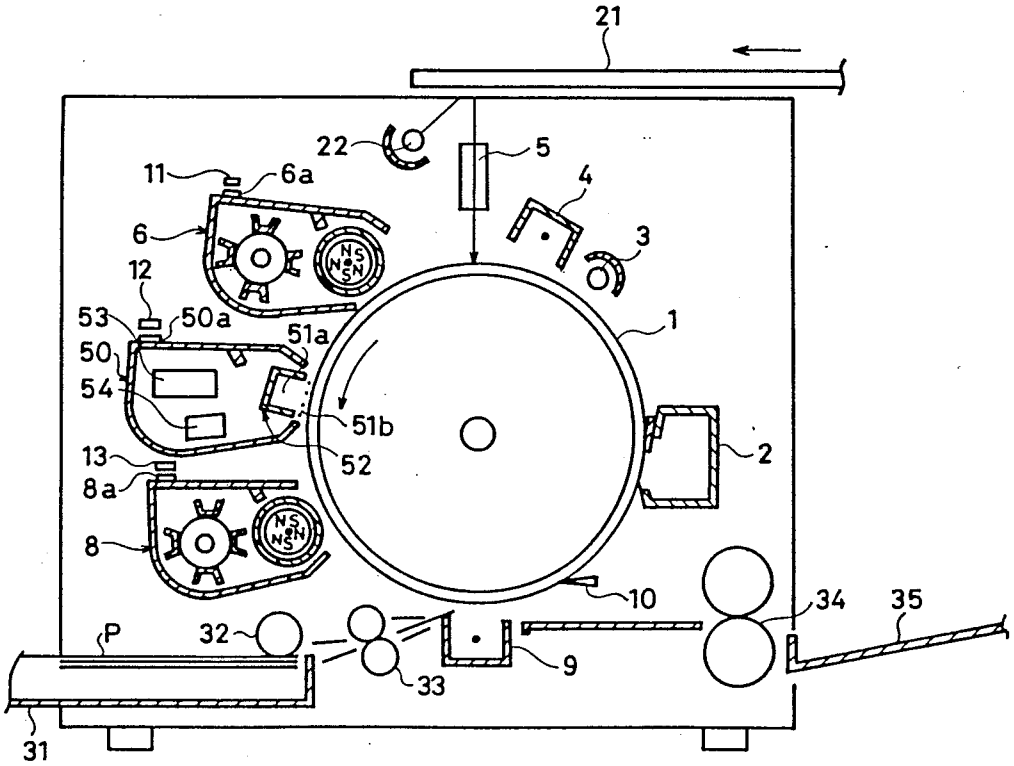
FIG. 2 is a cross sectional view showing a schematic structure of the copying machine of FIG. 1 when an outline unit is mounted thereto.

FIG. 2 shows the copying machine of FIG. 1 in which the outline unit 50 is mounted on the mounting portion at the middle stage instead of the developing unit 7. The appearance of the outline unit 50 is the same as the developing units 6, 7 and 8, and it can be mounted to each of the mounting portions in place of the developing unit 6, 7 or 8. In this example, it is mounted on the position of the unit 7. The DIP switch 50*a* is provided on the upper surface of the outline unit 50 as in the case of the developing units, and the 3 bit code signal is inputted to the CPU 100 through the connector 12. The mounting of the outline unit 50 is identified based on this signal. In this case, the developing unit 8 positioned on the downstream side of the outline unit 50 in the direction of rotation of the photoreceptor 1 can be operated not only in the normal operation mode but also in the outline mode.

The outline unit 50 comprises a scorotron charger 52 formed of a corona discharge electrode (charge wire) 51*a* and a grid 51*b* arranged between the corona discharge electrode and the photoreceptor drum 1, and first and second high voltage power supplies 53 and 54 for applying negative and positive direct current voltages to the corona discharge electrode 51*a* and to the grid 51*b*, respectively.

Figure 3:
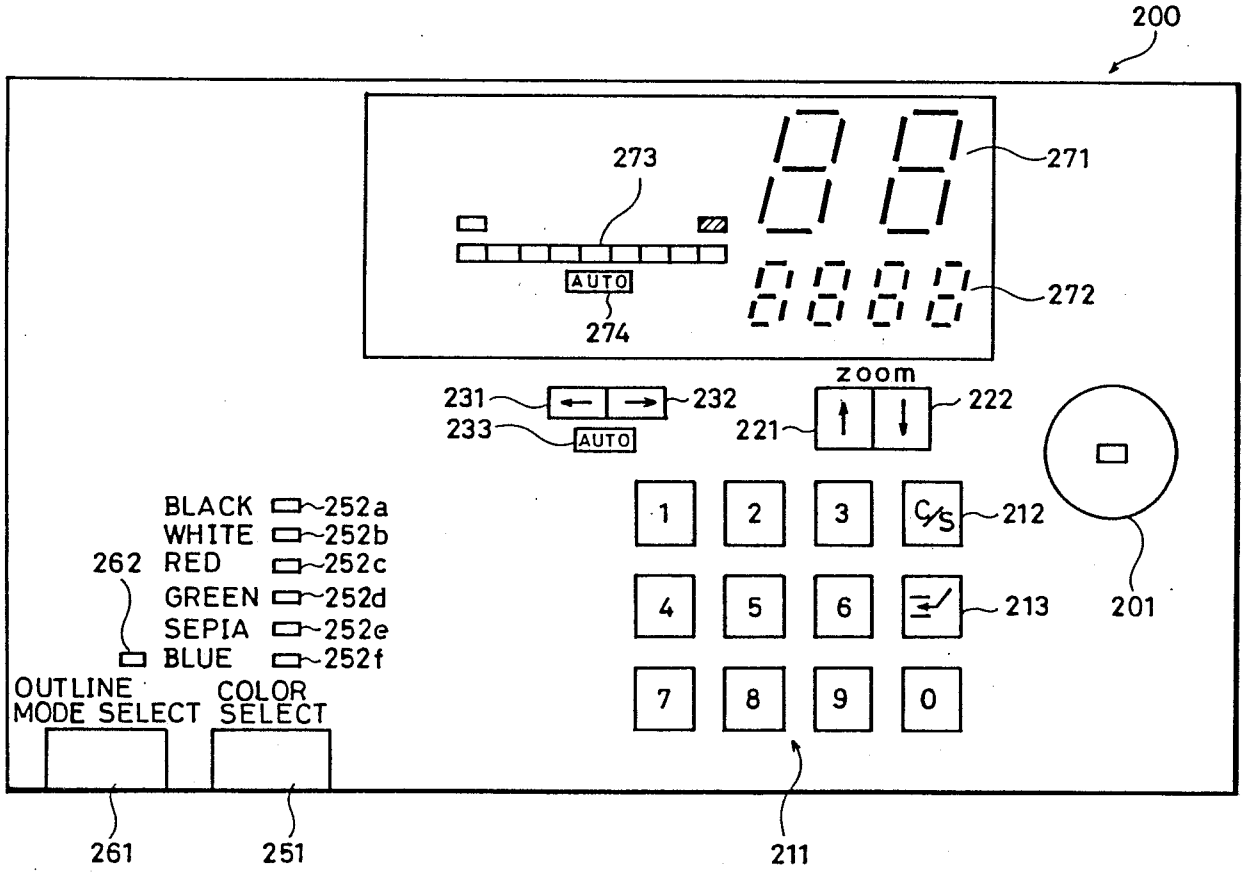
FIG. 3 view showing a structure of an operation panel of the copying machine in accordance with one embodiment of the present invention.

FIG. 3 shows an operation panel 200 attached to the body of the copying machine shown in FIG. 1. Arranged on the operation panel 200 are: a print key 201 instructing start of copying; ten keys 211 for inputting number of copies; a clear/stop key 212; an interruption key 213; zoom keys 221 and 222 for increasing and decreasing magnification rate, respectively; keys 231 and 232 for increasing and decreasing an amount of exposure in manual exposure; a AUTO switching key 233 for designating automatic adjustment of the amount of exposure; a color select key 251 for selecting a developing unit for the development; LED displays 252*a* to 252*f* indicating the color of the selected developing unit (black, white, red, green, sepia and blue); an outline mode select key 261 switching between the normal mode and the outline mode; an LED display 262 which is lit up when the outline mode is selected by the outline mode select key 261; numeral display 271 of two digits indicating the number of copies; numeral display 272 of 4 digits indicating the copying magnification rate; exposure step display 273 indicating the amount of exposure by 9 steps; and an AUTO display 274 indicating the automatic exposure mode.

Figure 4:
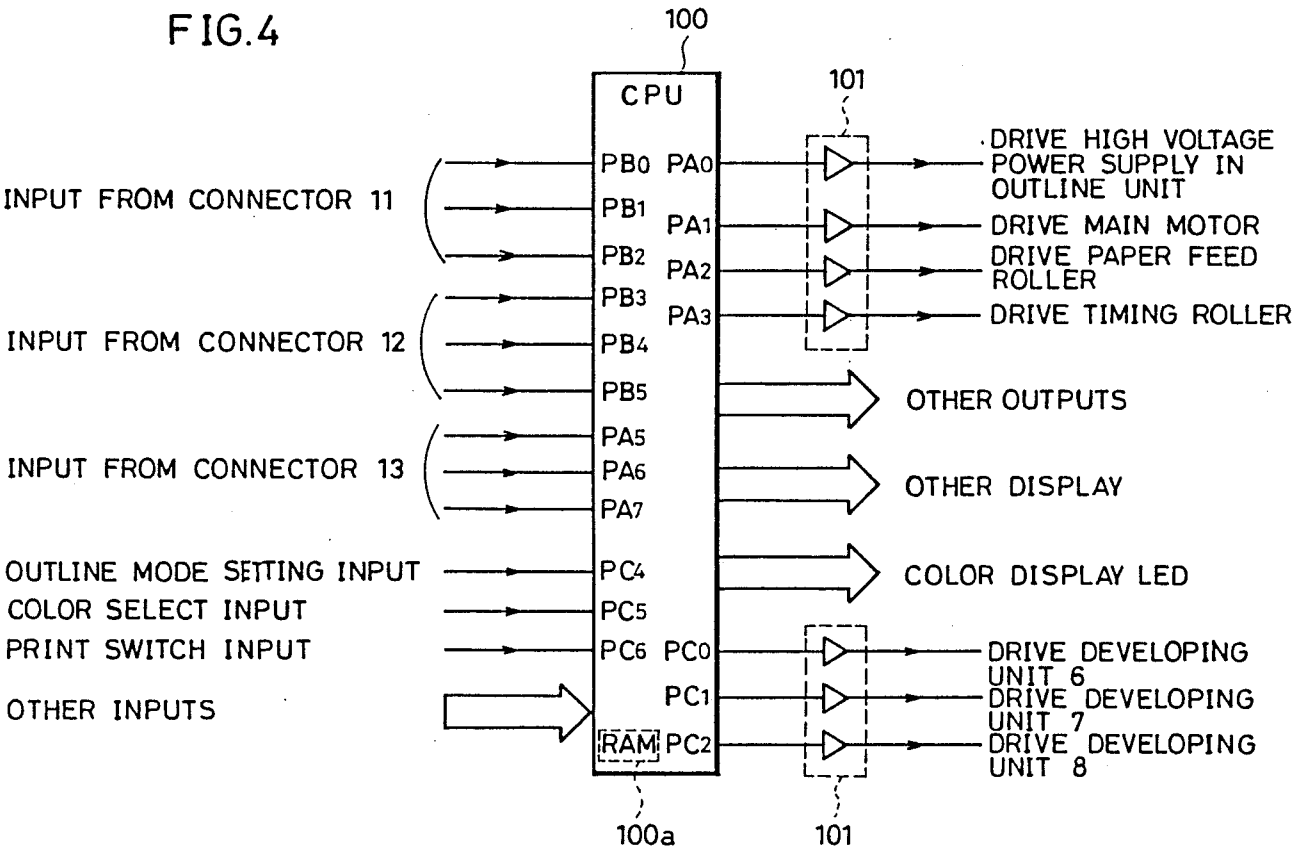
FIG. 4 is a schematic diagram showing a structure of a control system of the copying machine in accordance with one embodiment of the present invention.

FIG. 4 is a schematic diagram showing the control circuit in association with the CPU in accordance with one embodiment of the present invention. The CPU 100 takes information for the control of the copying machine, and sends information to peripheral circuits.

Output ports PA0, PA1, PA2 and PA3 for outputting signals to a driver IC 101 for driving the main motor and the like are provided on the CPU 100. Control signals for controlling the high voltage power supplies in the outline unit, the main motor driving portion and the paper feeding roller driving clutch are outputted from these output ports.

Output ports PC0, PC1 and PC2 output control signals for controlling clutches driving the developing units 6, 7 and 8. Input ports PB0 to PB5 and PA5 to PA7 receive 3 bit code signals through the connectors 11, 12 and 13 for identifying the units and the colors of the toner in the developing devices respectively mounted on the above mentioned units 6, 7 and 8. Each of the 3 bit code signals enables identification of the color of toner and the unit. Input ports PC4, PC5 and PC6 receive signals from the outline mode select key 261, the color select key 251 and the print key 201 on the operation panel 200.

(b) Outline forming mode

Figure 5:
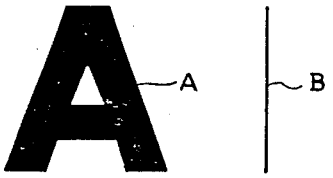
FIG. 5 shows examples of latent electrostatic images formed by the copying machine in accordance with one embodiment of the present invention.
Figure 6:
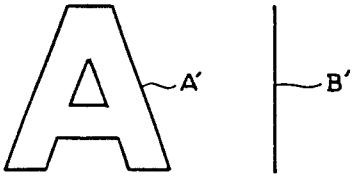
FIG. 6 shows examples of the latent electrostatic images shown in FIG. 5 with the outline portions emphasized by the outline unit.

A method for forming outline images will be described (see the related application USSN No. 16,716). By this method, an outline image (A') shown in FIG. 6 can be formed from the picture image (A) of FIG. 5 by extracting only the outline portions thereof. The line image (B) of FIG. 5 can be reproduced directly as the line image (B') of FIG. 6.

Figure 7A:
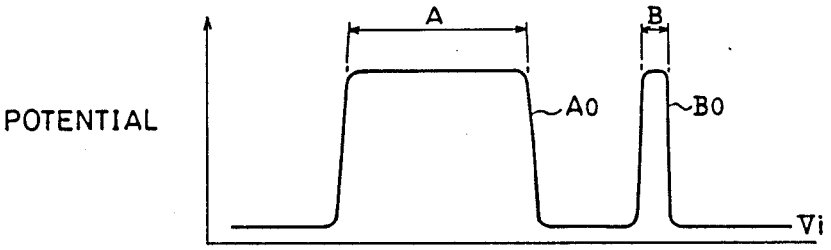
FIGS. 7A to 7C show changes of the potential of the latent electrostatic image on a photoreceptor in the outline forming mode.
Figure 7B:
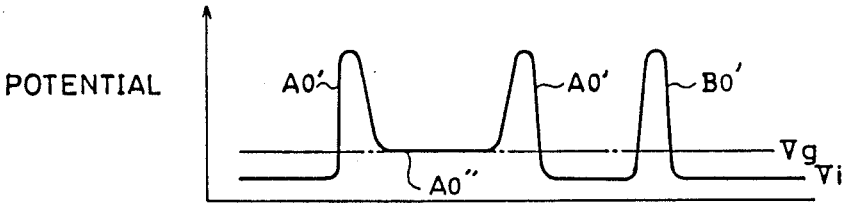

The principle of forming of outline images will be described with reference to FIGS. 7A, 7B, 7C and 8. First, a surface of the photoreceptor drum 1 rotating in the direction of the arrow (FIG. 2) is uniformly charged by a corona charger 4, and thereafter the images are exposed by an optical system. Consequently, latent electrostatic images ($A_0$) and ($B_0$) corresponding to the picture image (A) and line image (B) are formed as shown in FIG. 7A.

Thereafter, a negative high voltage is applied to the charge wire 51*a* of the scorotron charger 52 of the outline unit 50 while a grid voltage $V_g$ lower than the surface potential of said latent electrostatic images $A_0$ and $B_0$ is applied to the grid 51*b*. Consequently, the charger negative charges from the charge wire 51*a* reach the central portion of the picture image with the electric line of force extending in the direction of the grid 51*b*, and therefore the potential of the portions other than the outline portion $A_0'$ of the latent electrostatic image $A_0$ of the picture image are lowered to said grid volta $V_g$. As for the latent electrostatic image $B_0$ of the line image, the electric line of force do not extend to the direction of the grid 51*b*, and therefore the latent electrostatic image $B_0'$ is maintained as it is.

Figure 7C:
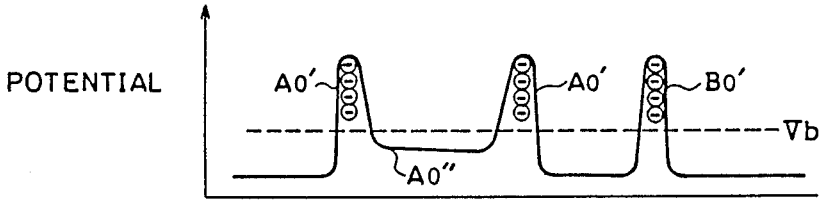
Figure 8:
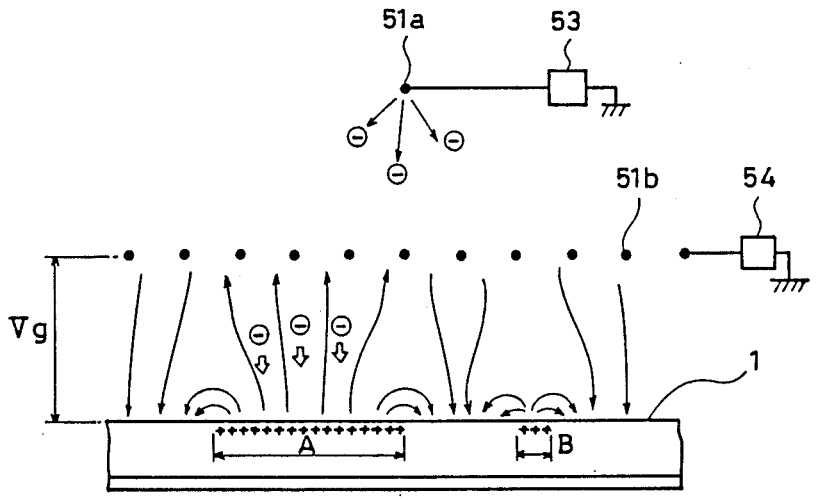
FIG. 8 shows a drawing for explaining the principle in forming the latent electrostatic image.

Thereafter, at the portion opposing to the developing unit, toner is supplied said latent electrostatic images $A_0'$ and $B_0'$ from a developing sleeve to which a developing bias voltage $V_b$ higher than said grid voltage $V_g$ is applied, as shown in FIG. 7C. The toner images are transferred onto a copying paper P to obtain the outline images of FIG. 6.

(c) Main flow of the copying machine

Figure 9:
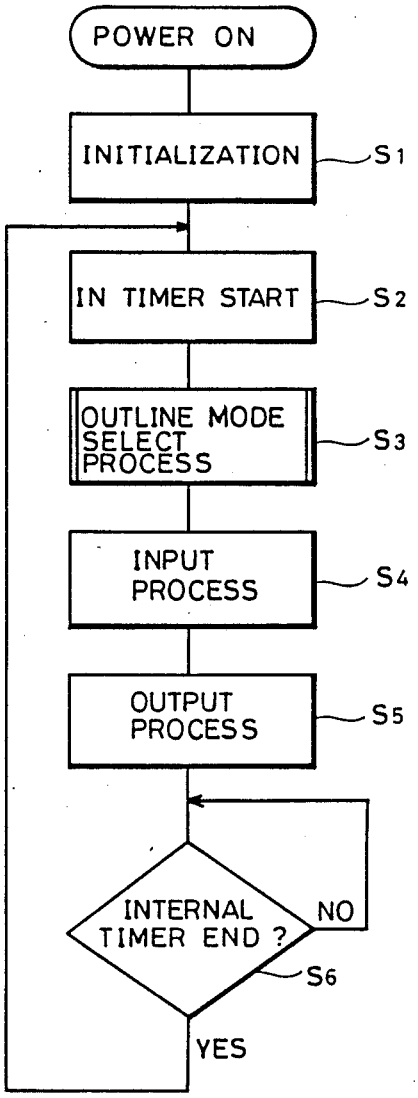
FIG. 9 is a flow chart showing a main routine of the copying machine in accordance with one embodiment of the present invention.

FIG. 9 is a main flow chart of the CPU 100 shown in FIG. 4 in relation to the operation of the copying machine. When the power is turned on, the internal register and various timers are initialized (step S1) and an internal timer defining the time of the main routine is started (step S2).

In the step S3, the control for selecting the outline mode, which will be described later, is carried out. Thereafter, input processes (step 4) and output processes (step S5) in association with the copying operation are carried out, and when the internal timer is terminated (step S6), the flow returns to the step S2.

As one output process in association with the copying operation, signals are outputted for the developing unit selected in the step S3 to drive the selected developing unit and the like in the output process (step S5).

(d) Flow of the outline mode

Figure 10A:
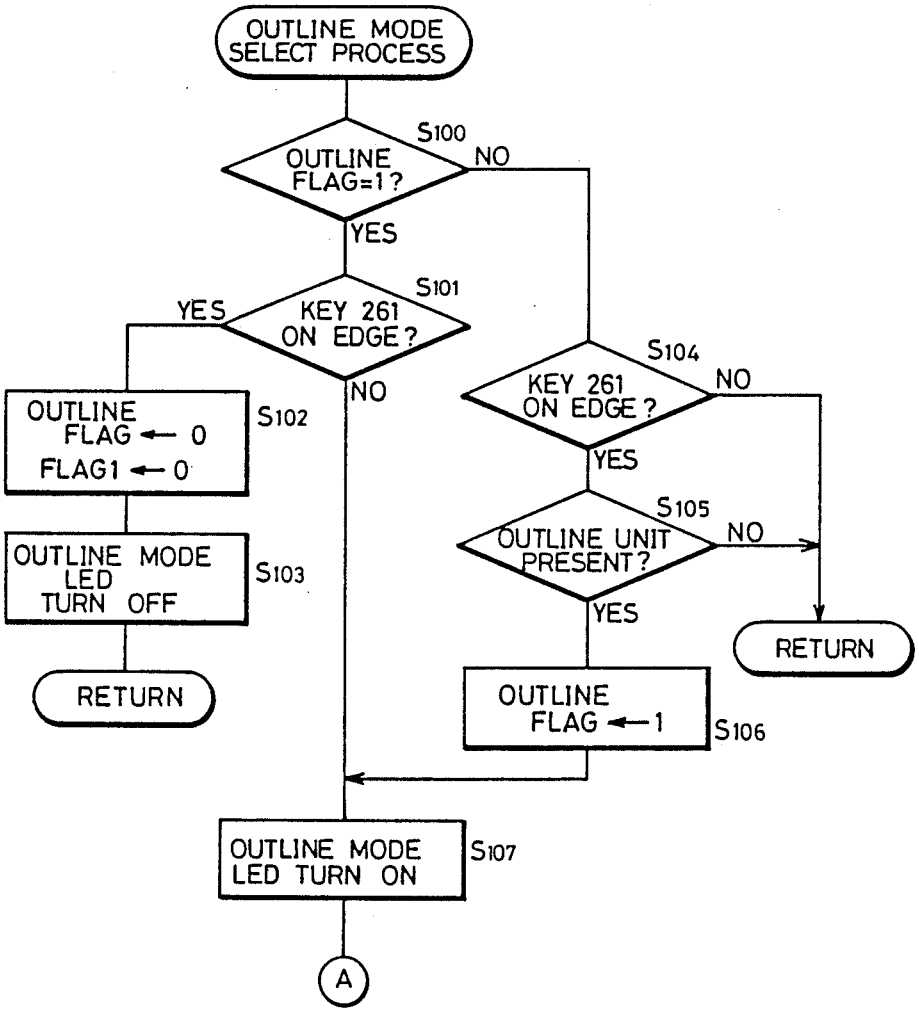
FIGS. 10A and 10B are flow charts concretely showing the steps of the outline mode selecting process in FIG. 9.
Figure 10B:
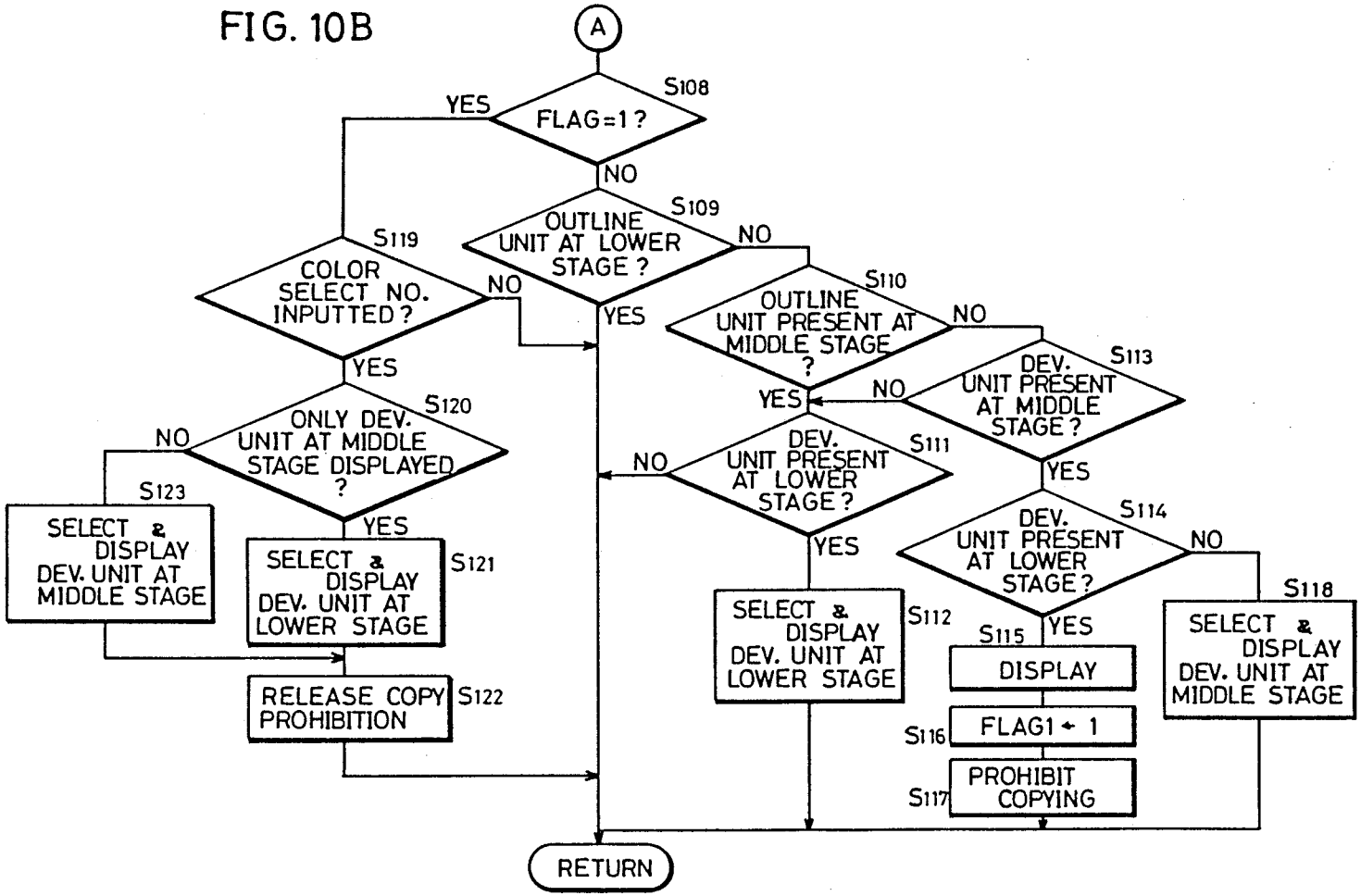

FIGS. 10A and 10B show the flow of the outline mode selecting process (step S3). In this flow, when the outline copy mode is selected, the colors of the toners of the developing units which can be selected are displayed on the operation panel 200.

First, in the step S100, an outline flag indicating whether the operation is in the outline mode or not is checked. If the outline flag is set at "1", namely, the operation is now in the outline copy mode, the flow proceeds to the step S101, and when the outline flag is "0", namely, the normal copying mode, the flow proceeds to the step S104. In the step S101, whether the ON edge of the outline mode select key 261 is detected or not is determined. The term ON edge means a change of the state of the key from OFF to ON. If the ON edge of the key 261 is detected in the step S101, the outline flag is set at "0" and the flag 1 is set at "0" in the step S102 to cancel the outline copy mode, and the outline mode LED 262 is turned off in the step S103.

Meanwhile, in the step S100, if it is determined that the operation is not in the outline copy mode, whether the ON edge of the outline mode select key 261 is detected or not is checked in the step S104. When it is determined that the ON edge is detected, the flow proceeds to the step S105. Whether the outline unit is mounted on any of the upper, middle and lower stages of the body of the copying machine or not is determined based on the signals inputted from the connectors 11, 12 and 13 in the step 105. If the outline unit is mounted, the outline flag is set at "1" to set the outline copying mode in the step S106, and the flow proceeds to the step S107. In the step S107, the outline mode LED 262 indicating that the outline copying mode is set is turned on. If it is determined that the outline unit is not mounted on any of the mounting portions in the step 105, the outline mode can not be set, and therefore the flow returns to the main flow.

Thereafter, whether the flag 1 is set at "1" or not is determined in the step S108. The flag 1 is set when the developing unit to be operated upon selection of the outline copying mode can not be specified in the following steps S110 to S118, and the developing unit must be selected by an input from the color select key 251 by the operator.

If it is determined that the flag 1 is set at "0" in the step S108, whether the outline unit is mounted on the mounting portion of the lower stage or not is determined in the step S109. If the outline unit is mounted on the mounting portion of the lower stage, that is, when there is no developing unit on the downstream side of the outline unit in the direction of rotation of the photoreceptor drum, the outline copy can not be carried out, and therefore the following processes are omitted and the flow returns to the step S4 of the main flow.

If it is determined that the outline unit is not mounted on the mounting portion of the lower stage in the step S109, whether the outline unit is mounted on the mounting portion at the middle stage or not is determined in the step S110. If it is determined that the outline unit is mounted on the mounting portion of the middle stage in the step S110, whether a developing unit is mounted on the mounting portion at the lower stage positioned on the downstream side of the outline unit or not is determined in the step S111. If the developing unit is mounted, the developing unit of the lower stage is selected in the step S112, and the developing color is displayed by one of the color display LEDs 252*a* to 252*f*.

If the outline unit is not mounted on the mounting portion of the middle stage in the step S110, namely, the outline unit is mounted at the mounting portion of the upper stage (the attachment of the outline unit has been confirmed in the step S105), whether developing units are mounted on the mounting portions at the middle stage and the lower stage on the downstream side of the outline unit or not is determined in the steps S113 and 114.

If no developing unit is mounted on the mounting portion of the middle stage (NO in the step S113) and the developing unit is mounted only on the mounting portion of the lower stage (YES in the step S111), the developing unit at the lower stage is selected in the step S112, and the developing color thereof is displayed by one of the color display LEDs 252*a* to 252*f*.

If the developing unit is mounted on the mounting portion of the middle stage (YES in the step S113) and the developing unit is not mounted on the mounting portion of the lower stage (NO in the step S114), the developing unit at the middle stage is selected in the step S118 and the developing color thereof is displayed by one of the color display LEDs 252*a* to 252*f*.

If the developing units are mounted on both mounting portions at the middle stage and the lower stage (YES in the step S113 and YES in the step S114), the developing unit to be selected can not be specified. Therefore, the developing colors of both developing units at the middle stage and the lower stage are displayed on the color display LEDs 252*a* to 252*f* in the step S115, and the flag 1 is set at "1" in the steps S116 and S117 to prohibit the copying operation until the developing color is selected by the color select key 251 by the operator.

If the developing unit is mounted neither on the mounting portion at the middle stage nor the mounting portion at the lower stage (NO in the step S113 and NO in the step S114), the outline copy can not be carried out, and the flow returns to the step S4 of the main flow.

Meanwhile, if it is determined that the flag 1 is set at "1" in the step S108, namely, the developing unit must be selected by the operator, whether there is an input from the color select key 251 or not is determined in the step S119. When the input is confirmed in the step S119, namely, when the developing unit is selected by the operator, whether only the developing color of the developing unit mounted on the mounting portion of the middle stage is displayed by the color display LEDs 252*a* to 252*f* or not is determined in the step S120. At the first input of the select key, two developing colors are displayed indicating the developing units of the mounting portions at the middle stage and the lower stage by the color display LEDs as shown in the step of S115. Therefore, in that case, the answer is NO in the step S120, and the flow proceeds to the step S123, whereby only the developing color of the mounting portion at the middle stage is left turned on. If it is determined that only the developing color of the middle stage is displayed in the step S120, the developing unit at the lower stage is selected in the step S121 and the color thereof is displayed. When the developing unit of the lower stage has been selected, the answer will be NO in the step S120, so that the developing unit at the middle stage is selected in the step S123 and the developing color thereof is displayed, and the copying operation prohibited state is released in the step S124.

The selecting operation will be described with reference to FIGS. 11A to 11D.

Figure 11A:
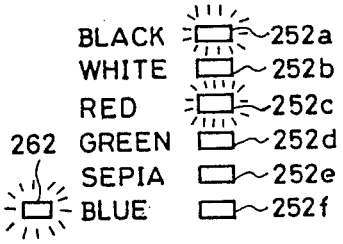
FIGS. 11A to 11D show the states of a display panel displaying color selection and outline mode selection.
Figure 11B:
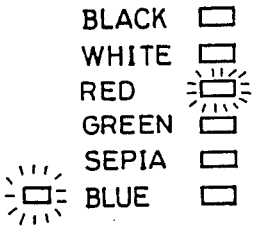

Let us assume that the outline unit 50 is mounted on the mounting portion at the upper stage, a developing unit 7 with red toner is mounted on the mounting portion at the middle stage, and the developing unit 8 with black toner is mounted on the mounting portion at the lower stage. If the outline mode is selected in this state, the colors of the toner in the developing units 7 and 8 on the downstream side of the outline unit are displayed as shown in FIG. 11A (step S113). Copying operation is prohibited in this state (S117). When the color select key 251 is pressed, the colors of the toner on the downstream side of the outline unit 50 are successively displayed (steps S121, S123). FIG. 11B shows a state in which the developing unit 7 with red toner is selected. When a color is selected, the prohibition of image formation is released.

Figure 11C:
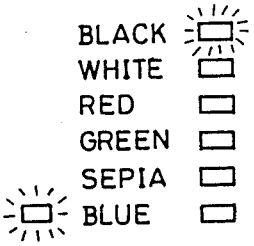

If the outline mode is set when the developing unit 6 with red toner is mounted at the upper stage, the outline unit 50 is mounted at the middle stage and the developing unit 8 with black toner is mounted at the lower stage, only the color of the black toner on the downstream side of the outline unit 50 is displayed as shown in FIG. 11C (step S112).

Figure 11D:
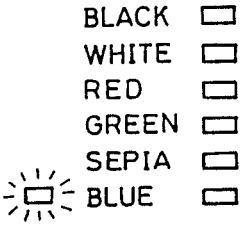

If the outline mode is selected when the outline unit 50 is mounted at the lower stage, the color of the toner is not displayed as shown in FIG. 11D, since there is no developing unit on the downstream side of the outline unit 50. This means that the copying operation can not be carried out in the outline mode.

Although three mounting portions are provided in the above described embodiment, the number of the mounting portions is not limited, and the present invention can be applied to copying machines having two or more mounting portions.

Although a copying machine capable of selecting the outline mode is employed in the above described embodiment, the present invention may be applied to copying machines capable of forming normal images and other types of images to provide the same effect.

If the outline mode is selected, the colors of the developing devices which can be used in the outline mode are displayed. Therefore, the user can check which colors can be used at one sight, whereby the trouble in the operation is eliminated, and the generation of miscopies can be suppressed. In addition, the image formation prohibited state is released only when the developing device which can be selected in the outline mode is selected, whereby miscopies can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying apparatus comprising:

a movable photoreceptor;

image forming means for forming a latent electrostatic image on said photoreceptor;

a plurality of mounting portions provided in the vicinity of said photoreceptor and along a direction of movement of said photoreceptor;

a plurality of developing units each of which can be mounted on and detached from each of said mounting portions, each said developing unit developing the latent electrostatic image on said photoreceptor, when each said developing unit is mounted on any one of said mounting portions;

an outline unit which can be mounted on and detached from each of said mounting portions for forming a latent electrostatic image with outline portions emphasized by applying charges to the latent electrostatic image on said photoreceptor formed by said image forming means, when said outline unit is mounted on any one of said mounting portions;

detecting means for detecting a developing color of at least one of said developing units mounted on any one of said mounting portions and the mounting position of said outline unit; and display means for displaying the developing color of at least one of said developing units which is mounted on the downstream side of the mounting position of said outline unit in the direction of movement of said photoreceptor, based on an output from said detecting means.

2. An electrophotographic copying apparatus comprising:

a movable photoreceptor;

image forming means for forming a latent electrostatic image on said photoreceptor;

a plurality of mounting portions provided in the vicinity of the photoreceptor and along a direction of movement of said photoreceptor;

a plurality of developing units each of which can be mounted on and detached from each of said mounting portions, each said developing unit developing the latent electrostatic image on the photoreceptor, when each said developing unit is mounted on any one of said mounting portions;

an outline unit which can be mounted on and detached from each of said mounting portions for forming a latent electrostatic image with outline portions emphasized by applying charges to the latent electrostatic image on said photoreceptor formed by said image forming means, when said outline unit is mounted on any one of said mounting portions;

mode selecting means for selecting an outline copying mode;

developing color selecting means for selecting any one of at least one of said developing units mounted on any one of said mounting portions; and control means for prohibiting a copying operation when the outline copying mode is selected by said mode selecting means and, thereafter, for releasing the prohibition of the copying operation when a developing unit is selected by said developing color selecting means.

3. An electrophotograhic copying apparatus according to claim 2, wherein said developing color selecting means comprises detecting means for detecting the mounting position of said outline unit and at least one developing unit mounted on the downstream side of said mounting position in the direction of movement of said photoreceptor, and for selecting one developing unit out of said at least one developing unit detected by said detecting means.

4. An electrophotographic copying apparatus comprising:

a movable photoreceptor;

image forming means for forming a latent electrostatic image on said photoreceptor;

a plurality of mounting portions provided in the vicinity of said photoreceptor and along a direction of movement of said photoreceptor;

a plurality of developing units each of which can be mounted on and detached from each of said mounting portions, each said developing unit developing the latent electrostatic image on the photoreceptor, when each said developing unit is mounted on said mounting portions;

an outline unit which can be mounted on and detached from each of said mounting portions for forming a latent electrostatic image with outline portions emphasized by applying charges to the latent electrostatic image on said photoreceptor, when said outline unit is mounted on a mounting portion;

instructing means for instructing the start of a copying operation;

mode selecting means for selecting an outline copying mode;

prohibiting means for prohibiting the copying operation when the outline copying mode is selected by the mode selecting means and there are a plurality of developing units mounted on the downstream side of the mounted outline unit in the direction of movement of said photoreceptor;

developing color selecting means for selecting any one of said plurality of developing units mounted on the downstream side in the direction of movement of said photoreceptor;

automatic selecting means for selecting, when the outline mode is selected by said mode selecting means and only one developing unit is mounted on a mounting portion on the downstream side of the outline unit in the direction of movement of said photoreceptor, said one developing unit;

means for releasing a copying operation prohibited state when a developing unit is selected by said developing color selecting means in the state in which the copying operation is prohibited by said prohibiting means; and executing means for activating said outline unit and the developing unit selected by said developing color selecting means or by said automatic selecting means in response to an output from said instructing means in the outline copying mode, to execute the copying operation.

5. An electrophotographic copying apparatus according to claim 4, further comprising detecting means for detecting the mounting position of said outline unit and at least one developing unit mounted on the downstream side of said mounting position of said outline unit in the direction of movement of said photoreceptor, wherein either said prohibiting means or said automatic selecting means is activated based on an output from said detecting means.

6. An electrophotographic copying apparatus comprising:

a movable photoreceptor;

a plurality of mounting portions provided in the vicinity of said photoreceptor and along a direction of movement of said photoreceptor;

first image forming means, which can be mounted on and detached from each of said mounting portions, for forming a first latent electrostatic image on said photoreceptor when said first image forming means is mounted on any one of said mounting portions;

a plurality of developing units each of which can be mounted on and detached from each of said mounting portions, each said developing unit developing the latent electrostatic image formed on said photoreceptor when each aid developing unit is mounted on any one of said mounting portions; and display means for displaying at least one of said developing units mounted on the downstream side of the mounting position of said first image forming means in the direction of movement of said photoreceptor.

7. An electrophotographic copying apparatus according to claim 6, further comprising second image forming means for forming a second latent electrostatic image on said photoreceptor, wherein said first latent electrostatic image comprises a latent electrostatic image with outline portions emphasized by applying charges to said second latent electrostatic image formed by said second image forming means.

8. An electrophotographic copying apparatus according to claim 7, wherein said display means comprises detecting means for detecting the mounting position of said first image forming means mounted on any one of said mounting portions, and at least one of the developing units mounted on the downstream side of the mounting position of said first image forming means in the direction of movement of said photoreceptor.

9. An electrophotographic copying apparatus according to claim 8, further comprising:

instructing means for instructing the start of development of said first latent electrostatic image; and control means for controlling the development of said first latent electrostatic image based on a detection output from said detecting means.

10. An electrophotographic copying apparatus according to claim 9, wherein said control means comprises first distinguishing means for distinguishing the presence/absence of at least one developing unit mounted on the downstream side of said first image forming means in the direction of movement of said photoreceptor;

prohibiting means for prohibiting the development of said first latent electrostatic image in response to an output indicating the absence of said at least one developing unit from said first distinguishing means;

second distinguishing means for distinguishing whether the number of said at least one developing unit mounted on said downstream side of said first image forming means is single or plural in response to an output indicating the presence of said at least one developing unit from said first distinguishing means;

selecting means for selecting one developing unit out of said at least one developing unit in response to an output from said second distinguishing means indicating that the number of said at least one developing unit is plural;

designating means for designating said at least one developing unit in response to the output from said second distinguishing means indicating that the number of said at least one developing unit is single, and for designating the developing unit selected by said selecting means in response to the output from said second distinguishing means indicating that the number of said at least one developing unit is plural, as the developing unit for developing said first latent electrostatic image; and developing means for developing said first latent electrostatic image by means of the developing unit designated by said designating means.

* * * * *

UNITED STATES PATENT AND TRADEMARK OFFICE

CERTIFICATE OF CORRECTION

PATENT NO. : 4,868,606

DATED : September 19, 1989

INVENTOR(S) : Hirohisa Miyamoto and Keiji Kusumoto

It is certified that error appears in the above-identified patent and that said Letters Patent is hereby corrected as shown below:

In col. 1, lines 10 and 11, delete "Description of the Prior Art".

In col. 1, between lines 10 and 12, insert the heading -- Description of the Prior Art --.

In col. 1, line 61, change "single" to -- simple --.

In col. 2, line 64, after "plays" insert -- the --.

In col. 2, line 64, after "of" delete -- the --.

In col. 3, line 20, after "FIG. 1" insert -- is a --. delete the comma "," after "structure".

In col. 3, line 21, after "structure" insert -- of a --.

In col. 3, line 26, after "FIG. 3" insert -- is a plan --.

In col. 3, line 65, delete "," (comma).

In col. 4, line 15, after "feeding" insert -- cassette --.

In col. 6, line 23, change "volta" to -- voltage --.

UNITED STATES PATENT AND TRADEMARK OFFICE

CERTIFICATE OF CORRECTION

PATENT NO. : 4,868,606

DATED : September 19, 1989

INVENTOR(S) : Hirohisa Miyamoto and Keiji Kusumoto

It is certified that error appears in the above-identified patent and that said Letters Patent is hereby corrected as shown below:

In col. 6, line 27, delete "to".

In col. 6, line 28, after supplied, insert -- to --.

In col. 10, line 37, change "electrophotograhic" to -- electrophotographic --.

In col. 11, line 58, change "aid" to -- said --.

Signed and Sealed this

Second Day of October, 1990

*Attest:*

HARRY F. MANBECK, JR.

*Attesting Officer*

*Commissioner of Patents and Trademarks*